US008434609B2

(12) United States Patent
Buerge

(10) Patent No.: US 8,434,609 B2
(45) Date of Patent: May 7, 2013

(54) METHOD FOR ALIGNING FLAT PRODUCTS ON A SIDE EDGE AND CONVEYING DEVICE FOR REALIZING THE METHOD

(75) Inventor: Marcel Buerge, Niedergoesgen (CH)

(73) Assignee: Mueller Martini Holding AG, Hergiswil (CH)

( * ) Notice: Subject to any disclaimer, the term of this patent is extended or adjusted under 35 U.S.C. 154(b) by 207 days.

(21) Appl. No.: 12/839,833

(22) Filed: Jul. 20, 2010

(65) Prior Publication Data

US 2011/0017571 A1 Jan. 27, 2011

(30) Foreign Application Priority Data

Jul. 21, 2009 (EP) ..... 09165957

(51) Int. Cl.
*B65G 47/244* (2006.01)

(52) U.S. Cl.
USPC ..... 198/415; 271/243; 271/248

(58) Field of Classification Search ..... 198/415, 198/411; 271/243, 248, 250
See application file for complete search history.

(56) References Cited

U.S. PATENT DOCUMENTS

| | | | | | |
|---|---|---|---|---|---|
| 3,897,053 | A * | 7/1975 | Guy | 271/238 |
| 4,085,839 | A * | 4/1978 | Crawford | 198/410 |
| 4,334,672 | A * | 6/1982 | Felix | 270/52.13 |
| 4,717,027 | A * | 1/1988 | Laure et al. | 209/620 |
| 4,967,899 | A * | 11/1990 | Newsome | 198/411 |
| 5,050,859 | A * | 9/1991 | Paxon | 271/270 |
| 5,080,666 | A * | 1/1992 | Kulpa et al. | 271/227 |
| 5,857,672 | A * | 1/1999 | Fowler et al. | 271/185 |
| 6,293,544 | B1 * | 9/2001 | Fedinatz | 271/243 |
| 6,425,475 | B1 * | 7/2002 | Franta | 198/415 |
| 6,622,847 | B2 * | 9/2003 | Schuitema et al. | 198/399 |
| 7,942,398 | B1 * | 5/2011 | Marcinik | 270/58.01 |
| 2005/0017440 | A1 * | 1/2005 | Jewell | 271/250 |

FOREIGN PATENT DOCUMENTS

| | | | |
|---|---|---|---|
| DE | 198 24 835 | A1 | 12/1999 |
| DE | 198 53 026 | C1 | 3/2000 |
| DE | 101 15 906 | A1 | 10/2002 |
| DE | 20 2005 010 981 | U1 | 10/2005 |
| EP | 0 356 864 | A2 | 3/1990 |
| EP | 1 620 210 | B1 | 2/2006 |
| WO | WO-96/34704 | A1 | 11/1996 |

OTHER PUBLICATIONS

European Search Report dated Jan. 13, 2010, issued in related European Patent Application No. 09 16 597.

* cited by examiner

*Primary Examiner* — Gene Crawford
*Assistant Examiner* — Keith R Campbell
(74) *Attorney, Agent, or Firm* — Venable LLP; Robert Kinberg

(57) ABSTRACT

A method is provided for alignment of flat products along a side guide of a conveying device. The products are conveyed successively while resting on their flat base area. Each product is positioned at an angle relative to the conveying direction while in an essentially horizontal plane. Subsequently each product is straightened. The straightened products are pushed against a side guide to align the products along the side guide. A conveying device is also provided to carry out the method.

15 Claims, 4 Drawing Sheets

METHOD FOR ALIGNING FLAT PRODUCTS ON A SIDE EDGE AND CONVEYING DEVICE FOR REALIZING THE METHOD

CROSS-REFERENCE TO RELATED APPLICATION

This application claims the priority of European Patent Application No. 09165957.3, filed on Jul. 21, 2009, the subject matter of which is incorporated herein by reference.

BACKGROUND

The invention relates to a method for aligning products with a flat base area, in particular printed products, on the side along a side guide of a conveying device on which the products are conveyed successively while positioned on their flat base. The invention further relates to a conveying device realizing the method.

Printed products which are produced, for example, in a gathering and wire-stitching machine as a rule must be aligned precisely before being trimmed in a trimmer. If all printed products have substantially the same width, they can be centered easily between two vertical belts. However, if printed products of different widths are processed successively, they must be aligned on the side, meaning they must be pushed against one side of the conveying device. Several solutions have already been proposed according to the prior art for aligning printed products on the side.

German patent document DE 0115906 A1 discloses a conveying device provided with a twisted conveying belt and thereto attached, spaced-apart roll discs. For the alignment of the objects on the side, these objects are moved transverse to the conveying direction on the conveying belt as a result of the twisting of the conveying belt.

A side pulling device is disclosed in German patent document DE 202005010981 U1 for which the printed products, conveyed in a sheet flow, are moved with the aid of a suction carriage against an end stop to align them on the side. The printed sheets to be aligned are respectively gripped with the clocking rate and pulled against the side end stop.

German patent document DE 19824835 A1 discloses a device for the side alignment of printed sheets which is also provided with a suction device for gripping the printed products and moving them to the side.

European patent document EP 1620210 B1 relates to a method for aligning flat shipments along a narrow side. These shipments are conveyed while standing upright and are aligned along a lower, narrow edge as a result of their gravity.

SUMMARY

It is an object of the present invention to provide a method of the aforementioned type which may permit an easier and more secure alignment of conveyed products having a flat base area.

The above and other objects are accomplished according to one aspect of the invention wherein there is provided a method for positioning the products which, in one embodiment, includes a method for alignment of products having a flat base area along a side guide of a conveying device, comprising: conveying each product successively while resting on the flat base area; positioning each product at an angle relative to the conveying direction while in an essentially horizontal plane; subsequently straightening each product; and pushing the straightened products against a side guide to align the products along the side guide.

According to a another embodiment of the invention, positioning the products at an angle is accomplished by providing the conveying device with end stops that also move along the conveying direction, and if the products are respectively placed with one front edge against a first one of the end stops for positioning them at an angle.

According to yet another modification of the invention, the products are to be fitted with the front edge against a second end stop during the straightening. This permits a particularly secure and precise alignment of the products. The first and the second end stop in this case may be arranged at a distance to each other along an imaginary line that extends transverse to the conveying direction. End stops of this type can be arranged on a conveying chain.

In a further embodiment the end stops may be moved in the conveying direction with a lower speed than the speed of the conveying elements.

Yet another embodiment provides that the side guide comprises a side belt, arranged essentially vertical, which moves along and on which the respective straightened out products are aligned with one side edge. A secure alignment maybe attained if the conveying device according to yet another modification of the invention is provided with at least one conveying element, extending substantially parallel and at a distance to the side guide as well as to the conveying direction, wherein this conveying element is angled toward the side guide in a downstream region of the conveying device. As a result, a force which is directed toward the side guide is exerted onto the products which rest with respectively one side edge on this conveying element and are already straightened out in this region.

According to another aspect of the invention there is provided a conveying device for side alignment of printed products with a flat base area conveyed in a conveying direction while resting on the flat base area, which according to one embodiment includes: at least two conveying elements to convey products successively positioned flat on the conveying device in the conveying direction while positioned at an angle relative to the conveying direction; a side guide extending in the conveying direction; and end stops arranged to straighten each product previously positioned at an angle and align each product on a side edge against the side guide.

The conveying device according to the invention may form a feed-in for a trimmer, for example, a three-way trimmer. The conveyed products can be printed products, meaning individual printed sheets, brochures, magazines, newspapers or book blocks. However, other products with a flat base area can conceivably also be conveyed, for example unprinted sheets of paper, products composed of different materials such as cartons, boxes, pallets or other types of packaging materials, with or without products located therein, as well as stacks of such products.

BRIEF DESCRIPTION OF THE DRAWINGS

The present invention will be more readily understood from the following detailed description when read in conjunction with the accompanying drawings, in which.

DETAILED DESCRIPTION

Figure 1:
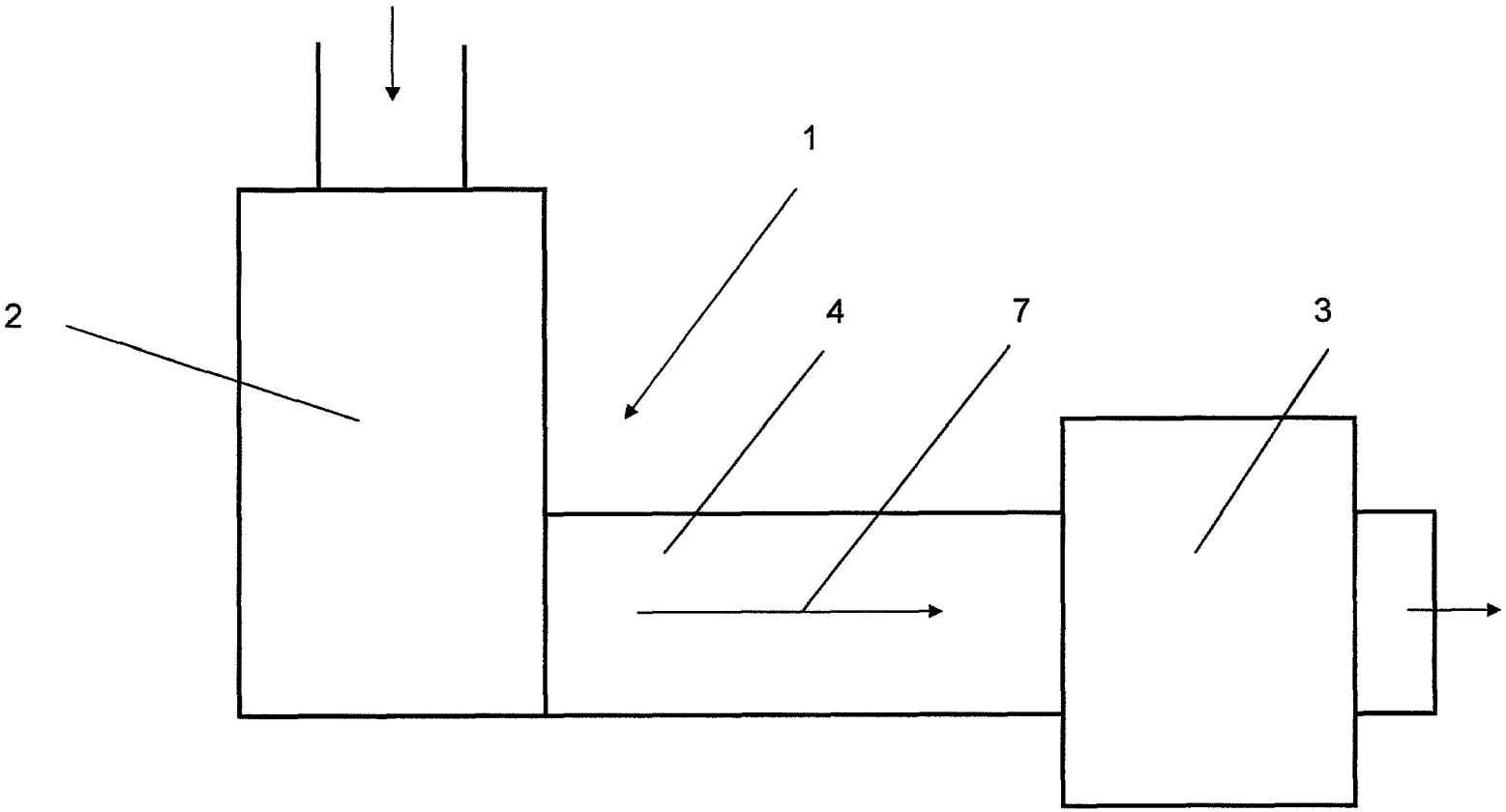
FIG. 1 is a schematic view of a conveying device according to the invention.
Figure 2:
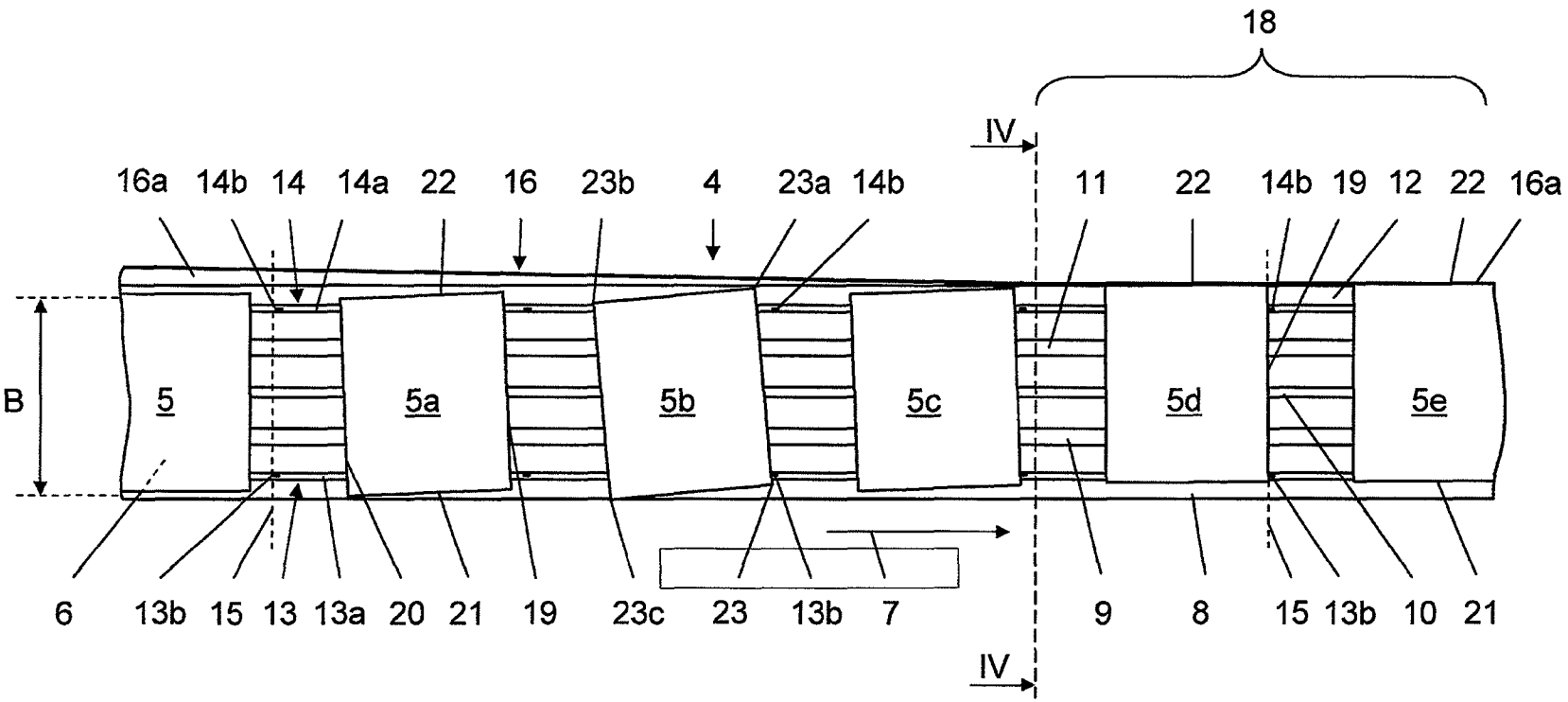
FIG. 2 is a schematic view from above of the conveying device according to the invention.

FIG. 1 shows a section of a processing device 1, comprising a stitching machine 2 which may be arranged, for example, downstream of a gathering and wire-stitching machine that is not shown herein, a trimmer 3 and a conveying device 4 which may be arranged in-between. In the stitching machine 2, the printed sheets or signatures gathered in the gathering and wire-stitching machine are stitched together, meaning they are processed further into a product 5 (FIG. 2). In one embodiment, they are processed to a printed product (e.g., a brochure). Following the stitching, the stitched products 5, which have a flat base area 6, may be transferred to the conveying device 4 which may feed the products 5 to the trimmer 3. The conveying device 4 may thus form a feed-in area for the trimmer 3. The latter may be a known three-way trimmer which can be used to trim the printed products 5 along three sides. For further processing, the printed products 5 may then be conveyed, for example, to a cross stacker which is not shown herein.

Figure 3:
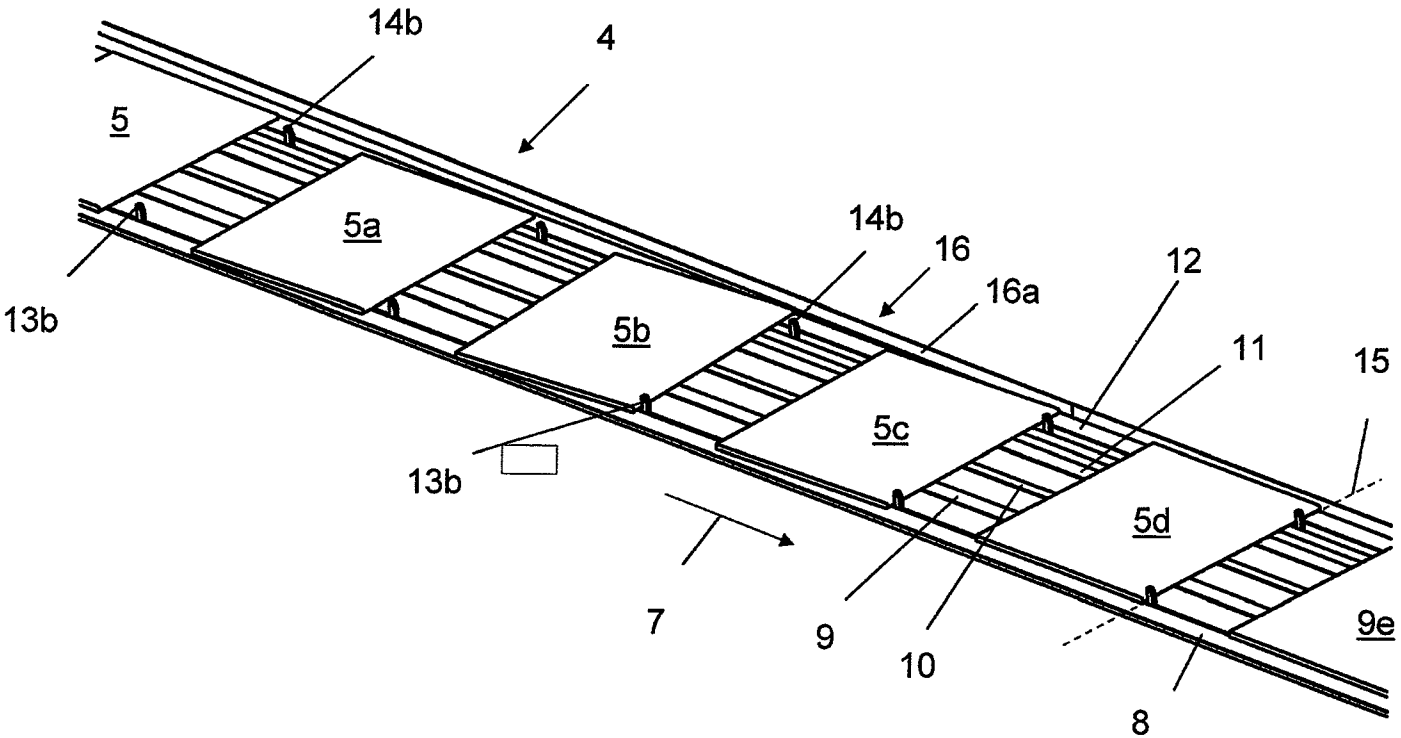
FIG. 3 is a perspective view of the conveying device according to the invention.

In the conveying device 4, the products 5 may be conveyed in a conveying direction 7, indicated by the arrow in FIGS. 1-3, while resting on the flat base area 6 and, in the process, may be aligned on the side. As a result of the side alignment, which is explained further below, it may be ensured that the products 5 may be trimmed precisely in the downstream arranged trimmer 3, essentially independent of their width B, or that they alternatively may be transported in a defined position to a different processing device.

Referring now to FIG. 2, for conveying the products 5, the conveying device 4 may be provided with five conveying elements 8, 9, 10, 11, 12 which may be embodied as belts. These belts can be guided and driven around rolls, not shown herein, or any other method known in the art. The conveying elements may be belts, chains, rollers or other devices known in the art.

First and second alignment elements 13, 14, respectively, for example, in the form of respective conveying chains 13*a*, 14*a*, may be arranged parallel to the conveying elements 8, 9, 10, 11, 12 as well as parallel to each other. The first conveying chain 13*a* may be provided with a plurality of uniformly spaced end stops 13*b* while the second conveying chain 14*a* may be provided with second end stops 14*b*, arranged in the same way. The conveying chains 13*a*, 14*a* may be also driven in any manner known in the art. The end stops 13*b*, 14*b* may be arranged in pairs and at a distance opposite each other and may be positioned on an imaginary line or axis 15 that extends transverse to the conveying direction 7. According to an embodiment, the spacing between the conveying elements 8, 9, 10, 11, 12 as well as between the alignment elements 13, 14 may be adjusted at right angles to the conveying direction 7 for the adaptation to the different widths B of the products 5.

The conveying device 4 may be provided with a side guide 16 which comprises a vertically extending side belt 16*a*, shown in particular in FIGS. 2 and 3. This side belt 16*a* may also be driven with a drive roller, not shown herein, and may be moved in the conveying direction 7. The side belt 16*a* may be arranged at a distance to the second conveying chain 14*a* and may form a side end stop against which the products 5 may be positioned.

Figure 4:
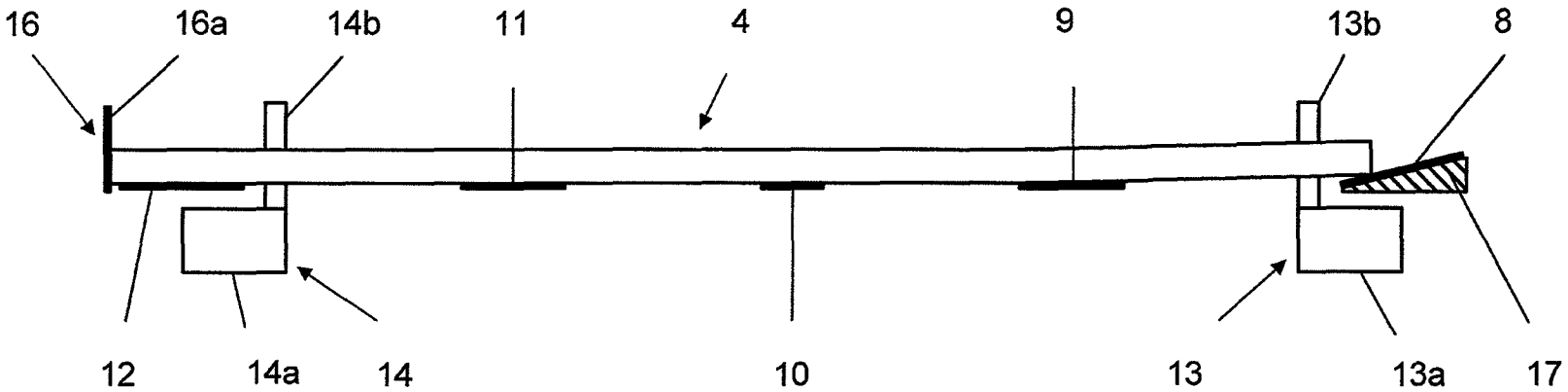
FIG. 4 is a vertical cross-section of the embodiment shown in FIG. 2.

In addition, the conveying device 4 may be provided with a wedge-shaped positioning element 17 (FIG. 4) that extends in the conveying direction 7 and may be located in a downstream region 18 of the conveying device 4, beneath the conveying element 8. The positioning element 17 may be arranged essentially parallel to the side belt 16*a* on the opposite edge of the conveying device 4 and may be embodied to be angled toward this side belt (FIG. 4). As a result of the angled positioning of the element 17, the conveying element 8 which rests thereon may also be angled in the region 18. The angle of inclination can differ, relative to the horizontal line, but may be less than 45°.

The distance between the first and the second conveying chain 13*a*, 14*a* may be considerably more than the distance between the first conveying chain 13*a* and the conveying element 8 or the distance between the second conveying chain 14*a* and the side belt 16*a*. The conveying elements 9, 10, 11, 12 may be arranged between the side belt 16*a* and the conveying element 8 and may be driven with different speeds. In one embodiment, the first conveying element 8 has the highest speed and the fifth conveying element 12 has the lowest speed while the conveying elements 9, 10, 11 and 12 arranged in-between have progressively lower speeds. The different speeds of the conveying elements 8, 9, 10, 11, 12 may be achieved, for example, by using drive rollers with different diameters which are not shown herein. The first conveying element 8 may be thus driven with a drive roller having the largest diameter as compared to the other conveying elements 9, 10, 11, 12. Both conveying chains 13*a*, 14*a* may be respectively driven with the same speed which may be furthermore lower than the speed of the fifth conveying element 12. The speed of the side belt 16*a* can be higher than that of the fifth conveying element 12, which may run approximately 20% slower.

The conveying device 4 may be used for transferring a product 5 to the trimmer 3 or any other suitable processing machine. The product 5 in that case may be positioned to rest with its base area 6 in a straight alignment on the conveying elements 8, 9, 10, 11, 12 and may be conveyed according to FIGS. 2 and 3 in the conveying direction 7, meaning from the left to the right. Since the conveying elements 8, 9, 10, 11, 12 move at different speeds, the product 5 may be moved to an angled position relative to the conveying direction 7 during the transport. In FIGS. 2 and 3, the product 5*a*, which leads product 5, has already been placed in the angled position. The front edge 19 of the product 5*a* and the back edge 20, which is parallel to the front edge, extend at an angle to the axis 15 that extends transverse to the conveying direction 7. A first side edge 21 and a second side edge 22 of the product 5*a* thus extend at an angle to the conveying direction 7. Since the first conveying chain 13*a* may be driven at a considerably lower speed than the first conveying element 8, the product 5*a* may be pushed against one of the end stops 13*b* in the region of the first of two corners 23, 23*b*. In the process, the first corner 23 may be displaced in the direction toward the side guide 16 and the side belt 16*a*. In FIG. 2, the leading product 5*b* already rests in the region of its first corner 23 against an end stop 13*b*. Based on the lower speed of the first conveying chain 13*a*, the first conveying element 8 pulls with sliding friction on the product 5*b*.

However, since the product 5*b* rests in the region of its first corner 23 against the first end stop 13*b*, this corner 23 cannot be moved faster in the conveying direction 7 than may be allowed by the speed of the first conveying chain 13*a*. Owing to the static friction of the conveying elements 9, 10, 11 and 12 on the product 5*b*, this product may be moved around the first end stop 13*b* and against the second end stop 14*b* and may be thus increasingly straightened out. Owing to the static friction between the respective first end stop 13*b* and the front edge 19 of the products 5*b* and 5*c*, the first corner 23 remains displaced in the direction toward the side guide 16 and the side belt 16*a*. The leading product 5*c* may be consequently angled less than the trailing product 5*b*. Finally, the front edge 19 of the leading product 5*d* rests against both end stops 13*b*, 14*b* and thus on the imaginary line 15 (FIG. 3) that extends transverse (i.e. perpendicular) to the conveying direction 7.

In the embodiment depicted in FIG. 2, the side belt 16*a* may extend, at least in some (upstream) parts, at an angle to the conveying direction 7, so that the distance between the side belt 16*a* and the conveying element 8 becomes increasingly smaller in the conveying direction 7. Once a predetermined distance may be reached, the side belt 16*a* moves parallel to the conveying element 8 in the downstream region 18 of the conveying device 4. At least by the time it arrives in the region 18, the side edge 22 of the product 5*d* rests against the side belt 16*a*. During the end of the straightening operation, the products 5*c* and 5*d* with back edges 20 move increasingly closer to the side belt 16*a* until they finally fit with their side edge 22 completely against the side belt 16*a* and may be thus aligned against this belt. The other side edges 21 of the products 5*d*, 5*e* continue to rest on the conveying element 8.

To prevent the front corner 23*a* and thus also the second side edge 22 from again sliding away from the side belt 16*a* during the end phase of the process for straightening the products 5*d*, 5*e*, the positioning element 17 (FIG. 4) may be arranged underneath the conveying element 8 in the region 18 of the conveying device 4. Owing to the resulting inclination of the conveying element 8, a force may be respectively exerted onto the first side edge 21 of the products 5*d*, 5*e*, in the direction of the side guide 16 and the side belt 16*a*, thus ensuring that the products 5*d*, 5*e* may be definitively positioned between the side belt 16*a* and the inclined conveying element 8. Alternatively, this can also be achieved with the aid of correspondingly arranged blast nozzles or other similarly effective elements known in the art. During the further conveying operation on the conveying device 4, the product 5*d*, 5*e* may be constantly pushed against the two leading end stops 13*b* and 14*b* as a result of the sliding friction of the conveying elements 8, 9, 10, 11 and 12.

In the embodiment shown in FIG. 2, the products 5 may be aligned on the left, relative to conveying direction 7. However, an embodiment may be also conceivable where the products 5 may be aligned on the right, relative to the conveying direction 7. The conveying device 4 can be converted relatively easily for this, simply by correspondingly exchanging the side belt 16*a* and the conveying element 8, including the positioning element 17. Conversion of the speeds of the conveying elements 8, 9, 10, 11, 12 can be achieved easily by correspondingly exchanging the drive rollers which are not shown herein.

The same effect could also be achieved where side belts 16*a* may be provided on both sides of the conveying device 4, wherein only one side belt 16*a* may be used, which may be arranged on the side used for the alignment on the conveying device 4. The distance between the two vertical side belts 16*a* in that case must be selected large enough so that sufficient space remains for positioning the products 5 at an angle.

In the illustrated embodiment, five conveying elements 8, 9, 10, 11, 12 are used to convey the products 5. However, an embodiment with more or fewer conveying elements may be also conceivable. The number of conveying elements in particular depends on the width B or the format of the products 5 or both. Depending on the product 5, the speed difference can vary between the fastest conveying element 8 and the slowest conveying element 12. For example, the speed difference between neighboring conveying elements may range from approximately 2 to 5%. The angled positioning of the products 5 can also differ. For example, the positioning angle can range from 10 to 30°. The minimum path required for the alignment depends on the respective product 5.

For example, the difference in width of the conveyed products 5 without having to convert the conveying device can be 10 mm. Thus, selectively produced products and products coming from different printing presses can also be aligned with the aid of the conveying device 4. A precise alignment may be possible even at comparatively high conveying speeds of, for example, 3 m/s and more, and thus a capacity of approximately 30,000 items per hour. In the process, the products 5 can be aligned on the side with a tolerance of approximately 1 mm.

Following a comparatively easy and fast conversion, the conveying device 4 can again be operated so that the products 5 may be centered between two vertical belts, as has been the norm. This may be possible even if the conveying elements 8, 9, 10, 11, 12 may be operated at different speeds.

The invention has been described in detail with respect to various embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A method for alignment of products having a flat base area along a side guide of a conveying device, wherein the conveying device comprises at least one pair of end stops that move along the conveying device and are separated in a direction transverse to the conveying direction, comprising:

conveying each product successively while resting on the flat base area;

positioning each product so that a front edge of the product comes to rest against one end stop of the at least one pair of end stops so that each product is disposed at an angle relative to the conveying direction while in an essentially horizontal plane;

subsequently straightening each product by fitting the front edge of the product against the other end stop of the at least one pair of end stops; and pushing the straightened products against a side guide to align the products along the side guide.

2. The method according to claim 1, wherein the conveying device comprises at least two conveying elements which extend in the conveying direction and are separated from each other in a direction transverse to the conveying direction, wherein the positioning of the products at an angle includes moving the at least two conveying elements at different speeds.

3. The method according to claim 1, further comprising two alignment elements that move in the conveying direction, wherein each end stop of the pairs of end stops is attached to a respective one of the alignment elements, and further comprising moving the end stops via the alignment elements in the conveying direction.

4. The method according to claims 3, further comprising moving the end stops at a speed that is slower than the speed of the conveying elements.

5. The method according to claim 3, wherein the alignment elements comprise conveying chains.

6. The method according to claim 1, wherein the side guide comprises an essentially vertical side belt, and the pushing includes aligning each straightened product with one side edge along the vertical belt.

7. The method according to claim 1, wherein the conveying device comprises at least one conveying element extending in the conveying direction essentially parallel to and at a distance from the side guide, and the method includes positioning one side edge on the at least one conveying element.

8. The method according to claim 7, further comprising positioning the at least one conveying element at an angle toward the side guide in a downstream region of the conveying device.

9. The method according to claim 8, wherein the positioning includes positioning the at least one conveying element at an angle relative to the horizontal plane toward the side guide in a downstream region of the conveying device; and the pushing includes positioning a side edge of the respective products that is remote from the side guide on the at least one conveying element.

10. A conveying device for side alignment of printed products with a flat base area conveyed in a conveying direction while resting on the flat base area, comprising:

at least two conveying elements to convey products successively positioned flat on the conveying device in the conveying direction while positioned at an angle relative to the conveying direction;

first and second end stops separated from each other along an axis that is transverse to the conveying direction first and second alignment elements movable in the conveying direction, wherein the first end stop is arranged on the first alignment element and the second end stop is arranged on the second alignment element, wherein the end stops are movable in the conveying direction via the alignment elements and the products are positioned against one of the end stops to position the products at the angle and fittable against both end stops to straighten the products again relative to the conveying direction; and a side guide extending in the conveying direction to align each product on a side edge against the side guide.

11. The conveying device according to claim 10, wherein the conveying elements are driven at different speeds to position the products at the angle.

12. The conveying device according to claim 10, wherein the alignment elements comprise conveying chains.

13. The conveying device according to claim 10, wherein the side guide comprises an essentially vertical side belt that is movable in the conveying direction and along which the products are to be aligned.

14. The conveying device according to claim 10, wherein the conveying elements comprise belts.

15. The conveying device according to claim 10, wherein one conveying element remote from the side guide extends in the conveying direction essentially parallel to and at a distance from the side guide and is positioned at an angle relative to the horizontal plane toward the side guide in a downstream region of the conveying device.

* * * * *